United States Patent [19]

Thornton

[11] Patent Number: 4,668,554

[45] Date of Patent: May 26, 1987

[54] COMPOSITE REFRACTORY PRODUCT

[75] Inventor: James M. Thornton, Helensburgh, Scotland

[73] Assignee: Thor Ceramics Limited, Scotland

[21] Appl. No.: 690,658

[22] PCT Filed: May 11, 1984

[86] PCT No.: PCT/GB84/00159

§ 371 Date: Jan. 10, 1985

§ 102(e) Date: Jan. 10, 1985

[87] PCT Pub. No.: WO84/04477

PCT Pub. Date: Nov. 22, 1984

[30] Foreign Application Priority Data

May 12, 1983 [GB] United Kingdom ..... 8313074

[51] Int. Cl.[4] ..... B22D 47/02; B22D 27/10; B22D 37/00

[52] U.S. Cl. ..... 428/36; 222/591; 222/603

[58] Field of Search ..... 222/591, 603; 428/35, 428/36

[56] References Cited

U.S. PATENT DOCUMENTS

| | | | |
|---|---|---|---|
| 3,404,061 | 10/1968 | Shane et al. | 161/125 |
| 3,435,992 | 4/1969 | Tisdale et al. | 222/591 |
| 3,475,244 | 10/1969 | Sanders, Jr. | 156/83 |
| 3,499,066 | 3/1970 | Murray | 264/56 |
| 4,108,339 | 8/1978 | Lunde | 222/591 |

FOREIGN PATENT DOCUMENTS

| | | |
|---|---|---|
| 0059805 | 9/1982 | European Pat. Off. . |
| 2740070 | 3/1978 | Fed. Rep. of Germany . |

*Primary Examiner*—John E. Kittle

*Attorney, Agent, or Firm*—Gerald J. Ferguson, Jr.; Ronni S. Malamud; Michael P. Hoffman

[57] ABSTRACT

A composite refractory product, for example a subentry nozzle for use in the pouring of molten metal comprises a body of refractory material having therein or thereon a flexible gas-impermeable membrane formed from a compatible refractory material preferably flexible graphite to render at least a portion of said body impermeable to gas. Such a product is manufactured by providing within an isostatic pressing mould a flexible gas-impermeable membrane and particulate refractory materials, said membrane being formed from a refractory material compatible with the particulate refractory material and being suspended or supported in the mould such that following packing of the particulate refractory materials in the mould and isostatic pressure upon the mould a refractory body having the said flexible membrane in or on the body at a predetermined location is provided.

7 Claims, 3 Drawing Figures

COMPOSITE REFRACTORY PRODUCT

This invention relates to the manufacture of refractory products used for handling and conveying molten metals. Thus this invention is particularly concerned with nozzles, ladle to tundish shrouds, valves, blocks, stoppers and crucibles. All these find a use in melting, containing or pouring of molten steel in steel works, steel foundries and iron foundries but especially in continuous casting operations. There are also applications for refractory products in the melting, containing or pouring and forming of non-ferrous metals such as copper based alloys and aluminium.

The refractory materials used for this purpose generally comprise graphite, alumina and silica or silicon carbide with small quantities of special purpose additives. Depending on the method used to form a product from these materials, the product may be permeable or non-permeable. Similarly the type of additives included in the product affect such properties as electrical resistivity, resistance to erosion and corrosion by the melt and slag and thermal shock resistance.

One method which has been found to be particularly effective in producing such products is that involving isostatic pressing of a fine particulate refractory material in a mould to shape the product.

An object of the present invention is to provide an improvement in this method whereby more control over the properties of the finished product is obtained and thereby provide an improved product capable of many specialised applications.

According to the present invention there is provided a composite refractory product for use in the handling of molten metal comprising a body of refractory material having therein or thereon a flexible gas-impermeable membrane formed from a compatible refractory material to render at least a portion of said body impermeable to gas.

The term "refractory material" as used herein means a material capable of withstanding the conditions normally found in molten metal handling when used in the manner described herein and includes silica, silicon carbide, alumina, graphite/alumina, zirconia, magnesite, boron or silicon nitride and graphite or carbon/-graphite mixtures.

The term "compatible refractory material" means a refractory material which in comparison with another refractory material required to form the intended refractory product is sufficiently similar thereto in chemical and physical properties as to allow isostatic pressing to form a usable product and thereafter withstand the conditions of use without degradation of the product. In view of the intended use of such a product, the only property which requires careful consideration is the thermal expansion coefficient and it is expected that a wide range of refractory materials may be combined to form a product for the purposes outlined herein. For example where the product is to be made primarily from alumina, a flexible membrane made from alumina would be preferred. Boron or silicon nitrides are also suitable but more expensive. Flexible graphite which has been found to be effective for the purposes of this invention is commercially available and information on manufacture thereof can be found in U.S. Pat. No. 3,404,061.

The membrane can be made from known flexible graphite sheets or tape but can alternatively be made from carbon/graphite produced, for example, from carbon fibres, or from similar fibres.

Further according to this invention there is provided a method of manufacturing the composite refractory product which comprises providing within an isostatic pressing mould a flexible gas-impermeable membrane and particulate refractory materials, the said membrane being formed from a refractory material which is compatible with the particulate refractory materials and being suspended or supported in the mould such that after packing of the particulate refractory materials in the mould and subjecting the mould to isostatic pressing a refractory body having the said flexible membrane in or on the said body at a predetermined position is produced.

Preferably the flexible gas-impermeable membrane is formed from a flexible graphite sheet or strip into a tubular form. The tubular shaped membrane is suspended or supported in the mould and refractory materials are packed around the membrane.

The invention will now be described by way of example with reference to the accompanying drawings in which.

EXAMPLE 1

Figure 1:
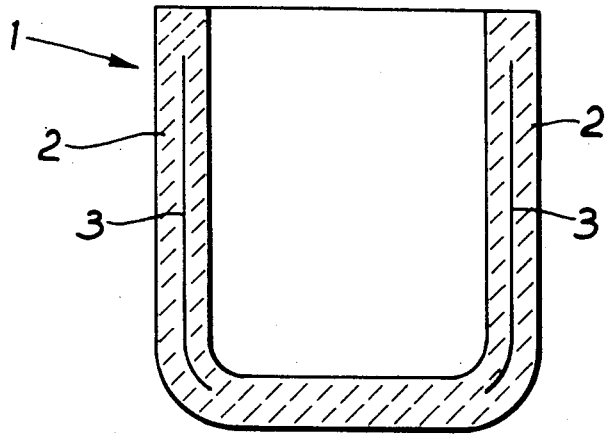
FIG. 1 shows a section through an induction crucible of this invention.
Figure 2:
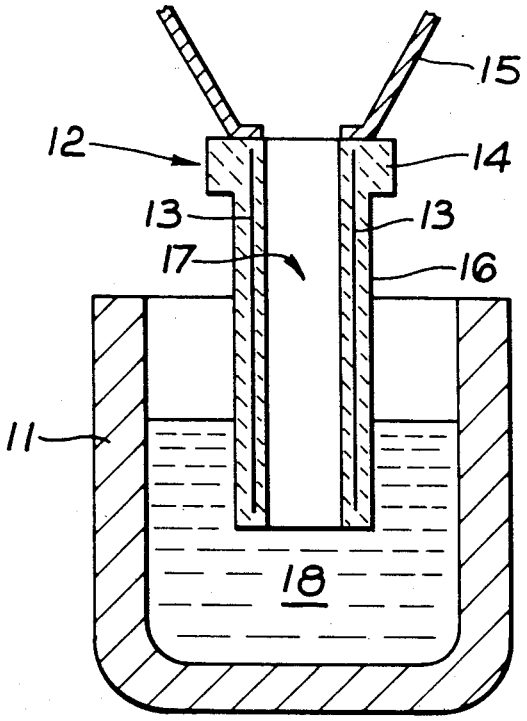
FIG. 2 shows a section through a riser tube for low pressure die casting.
Figure 3:
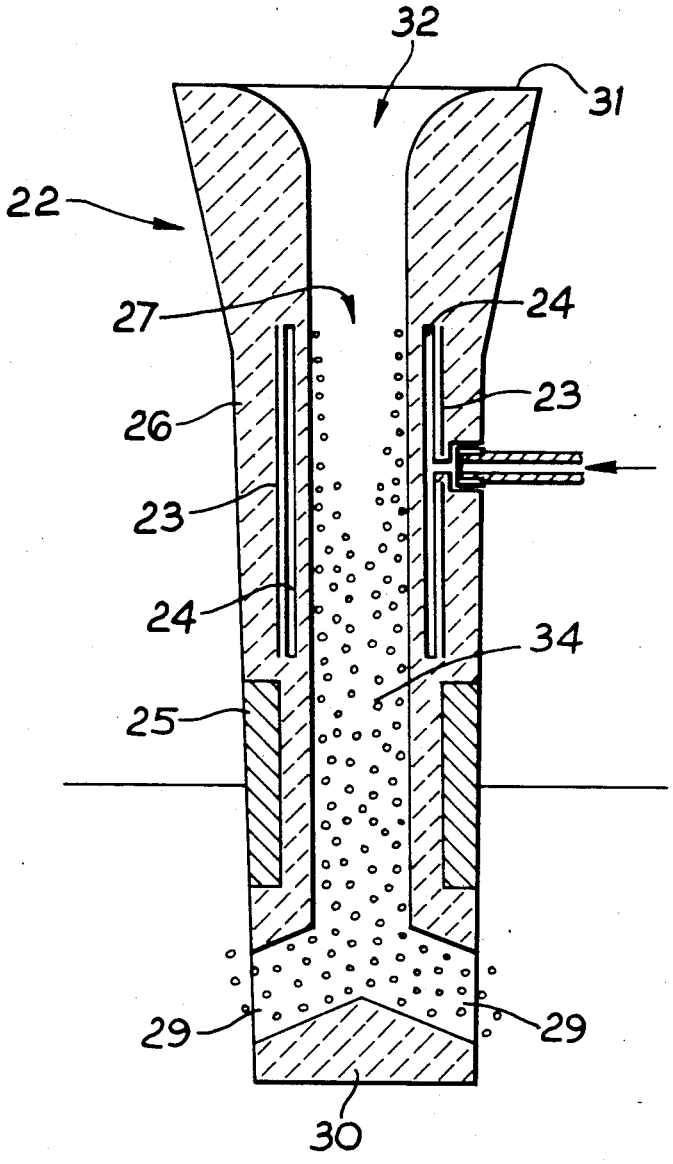
FIG. 3 shows a section through a sub-entry nozzle or shroud for pouring steel.

An induction crucible 1 is formed by an isostatic pressing method so as to include in the side walls 2 of the crucible 1 a barrier 3 made from a flexible graphite material.

One way of forming such a crucible is to suspend a substantially cylindrical membrane made from the flexible graphite material within the mould assembly using specially designed jigs or tools and surrounding it by the powdered refractory material to fill out the mould in the normal way. Thereafter the normal isostatic pressing methods are carried out followed by drying and firing processes applicable to the product being manufactured.

The crucible so formed is less permeable to gases which is useful for handling of molten alloys which are very sensitive to oxidation. In addition the electrical resistivity of the crucible is modified by the internal graphite barrier so that improved heating is possible and more accurate control of the alloy product obtained.

EXAMPLE 2

A riser tube 12 comprises an upper annular portion 14 for connection to a die or mould 15, and a cylindrical portion 16 forming a bore 17 through which a molten metal 18 such as aluminum is drawn under vacuum from a crucible 11.

The riser tube 12 is formed to include a gas impermeable barrier 13 made from a flexible graphite material.

The riser tube can be suitably formed by providing a flexible mould, inserting a preformed cylinder of flexible graphite in the mould and suspending it in a suitable position, using specially designed jigs and tools before filling the mould with a fine powdered refractory material and subjecting the filled mould to isostatic pressing procedures.

The moulded riser can then be subjected to the drying, curing and firing processes applicable to the product being manufactured.

In use the riser tube 12 is connected by means of the annular portion 14 to a vacuum forming die or mould 15 and a melt 18 is brought into contact with the riser so that it is immersed therein. Due to the presence of the gas impermeable barrier 13 air which may normally be drawn through the porous refractory material by the vacuum is excluded. This means that less power is required to maintain the vacuum and that the formed aluminium product is made of purer metal, the possibility of oxide formation being dramatically reduced.

EXAMPLE 3

A sub-entry nozzle or shroud 22 for use in pouring of steel especially in continuous casting operations comprises an elongate tapering body 26 defining a bore 27 having bifurcated outlets 29 at one end 30. The other end 31 provides an inlet 32.

In this embodiment the body 26 has an "armoured" region 25 in the form of an annular band of wear and corrosion-resistant refractory material. This armoured region 25 is located so that in use, the normal erosive and corrosive effect caused by contact between the nozzle 22 and slag and steel is resisted by this region whereby the life of the nozzle 22 is prolonged.

The body 26 further includes gas distribution channels 24 for introducing an inert gas into the pore structure of the nozzle thus reducing the tendancy for oxide build up on the walls of the bore which would otherwise reduce steel flow through the nozzle.

Adjacent the gas distribution channels 24 there is provided a gas impermeable barrier 23 formed from a flexible graphite material. This is in the form of a tubular member enclosing the channels 24 so that gas 34 issuing from the channels 24 is directed towards the bore 27. Thus the bulk of the gas, an expensive material, is usefully employed at the refractory body—molten steel interface and is not lost through the outer surfaces of the nozzles.

The sub-entry nozzle or shroud described above can be formed by an isostatic pressing method as is known in the art but modified as follows:

The filling of the mould is carried out in such a manner, using a series of specially designed jigs and tools, as to position accurately $Al_2O_3$—C material, $ZrO_2$—C material at the slag line region, and a sacrificial void former and impermeable membrane accurately located at the desired position within the tube.

The filled mould is then subjected to isostatic pressing techniques and the subsequent drying, curing and firing processes applicable to the product being manufactured.

The above described sequence of operations for filling the moulds is not essential and variations therein may be made in order to obtain the most convenient method for the product concerned.

Although in each of the examples given above a tubular graphite membrane was used, other shapes can be used to suit particular applications. Similarly recent chemical products of a similar nature to carbon fibres and containing boron and silicon can be used to form the membrane.

I claim:

1. A composite refractory product for use in the handling of molten metal comprising a body of refractory material having therein or thereon a flexible gas—impermeable membrane formed from a compatible refractory material to render at least a portion of said body impermeable to gas.

2. A product according to claim 1 wherein the flexible membrane is formed from alumina, graphite, alumina/graphite mixtures, carbon/graphite mixtures or boron or silicon nitrides.

3. A product according to claim 1 wherein the membrane is a flexible graphite membrane.

4. A product according to any one of claims 1 to 3 wherein the flexible membrane is in the form of a cylindrical membrane contained within the product.

5. A method of manufacturing the composite refractory product claimed in claim 1 which comprises providing within an isostatic pressing mould a flexible gas—impermeable membrane and particulate refractory materials, the said membrane being formed from a refractory material which is compatible with the particular refractory materials and being suspended or supported in the mould such that after packing of the particulate refractory materials in the mould and subjecting the mould to isostatic pressing a refractory body having the said flexible membrane in or on the said body at a predetermined position is produced.

6. A method according to claim 5 wherein the flexible gas impermeable membrane is formed from a flexible graphite sheet or strip into a tubular form.

7. A method according to claim 5 or claim 6 wherein a sacrificial void former material is packed in the mould adjacent one surface of the membrane, said surface being one which in the finished product faces the interior of the refractory body.

* * * * *